United States Patent [19]

Straffi

[11] 4,021,204

[45] May 3, 1977

[54] METHOD OF MANUFACTURING A GRILL-TYPE SUPPORT COMPRISING TWO DIFFERENT MATERIALS AND CAPABLE OF BEING INITIALLY RIGID, WHILE ALLOWING DIFFERENTIAL THERMAL EXPANSIONS AFTER INSTALLATION

[75] Inventor: Franco Straffi, Dresano (Milan), Italy

[73] Assignee: Breda Termomeccanica S.p.A., Milan, Italy

[22] Filed: Sept. 25, 1975

[21] Appl. No.: 616,665

[30] Foreign Application Priority Data

June 9, 1975 Italy ..... 24128/75

[52] U.S. Cl. ..... 29/157.3 R; 29/423; 156/155; 165/162

[51] Int. Cl.[2] ..... B21D 53/02; B23P 15/26

[58] Field of Search ..... 29/157.3 R, 157 R, 160, 29/163.5 R, 200 J, 423, 434, 455 R, 464, 467, 428, 525; 156/155, 305; 165/162, 161

[56] References Cited

UNITED STATES PATENTS

| | | | |
|---|---|---|---|
| 3,327,371 | 6/1967 | Kerns et al. | 29/467 X |
| 3,420,297 | 1/1969 | Romanos | 165/162 |
| 3,745,630 | 7/1973 | Bensinger | 29/434 X |
| 3,838,493 | 10/1974 | Zaburanec | 29/464 X |
| 3,907,031 | 9/1975 | Tegethoff | 165/162 |
| 3,924,314 | 12/1975 | Ferchland | 29/423 X |

*Primary Examiner*—Victor A. DiPalma
*Attorney, Agent, or Firm*—Fleit & Jacobson

[57] ABSTRACT

A method of manufacturing a grill-type support suitable to act as a support and tube spacing member for steam generators (particularly natural circulation steam generators for pressure water reactors), heat exchangers and the like, wherein the actual lattice of the grid comprises strips having a certain thermal expansion, whereas the frame is made of another material having different thermal expansion, and during assembling the outer frame is connected to the strips, so as to be fast therewith and remains so for all the time required for manufacture, transport and erection, whereas as soon as said generator is set to work said strips of different material can slide relative to said frame, so that, said frame while surrounding and supporting such strips, allows a different thermal expansion for said central strips and frame.

9 Claims, 7 Drawing Figures

METHOD OF MANUFACTURING A GRILL-TYPE SUPPORT COMPRISING TWO DIFFERENT MATERIALS AND CAPABLE OF BEING INITIALLY RIGID, WHILE ALLOWING DIFFERENTIAL THERMAL EXPANSIONS AFTER INSTALLATION

This method is concerned with the manufacture of a grill-type support comprising a frame and inner elements formed of strips or plates, said frame and said inner elements or strips being made of two different materials having different thermal expansions. Said grill-type supports or grids are particularly used for supporting and spacing apart the tubes of heat exchangers, steam generators (particularly, natural circulation steam generators for pressure water reactors) or for other similar uses.

Two primary problems arise in such a type of grid: the first problem is that of allowing in operation a differential thermal expansion for the two parts comprising the grid, which parts are made of different materials. The second problem is to realize a grid so that during the steps of tubing manufacturing, transport and installation in situ, this will be as rigid as possible, that is a grid which will not warp, buckle or settle under the tube weight. Moreover, such a type of grid should be adjustable with respect to the end tube sheet, so that the recticular positions intended to carry the tubes are and remain perfectly aligned due to their stiffness, so that tubing will be easy at the beginning as at the end of the process, that is such tubes would never force or strain.

These are contrasting requirements, since rigidity generally prevents a free expansion of the central portion made with a certain material relative to the frame, which is made of a different material.

This difficulty has been overcome according to the present invention by providing a fastening means for the frame to the inner strips forming the actual grid lattice, which means is effective during the steps of assembling, transport and installation in situ of the steam generator, and can be made inoperative and thereby allow a free expansion as soon as the generator is operated.

Preferably, this fastening means for the frame to the inner strips comprises a glue or paste which breaks, melts or becomes loose when attaining a high temperature which, however, is lower than the normal operating temperature of the generator, or this glue may be soluble with hot water, or by other solvent.

According to a further improvement of the invention, it is also contemplated that a layer of glue or paste can be applied about the outer periphery of the grid frame, or on equivalent external elements, so that on melting this layer will create a certain play or clearance for allowing an axial sliding movement along the generator, that is a slight displacement of the whole grid in a perpendicular direction to its own plane.

Finally, to align each grid with the end tube sheet, the present invention provides that the outside of the grid frame is inclined and that wedge members are inserted to a larger or smaller depth therebetween and the outer housing or wrapper, such wedge members providing for the required alignment.

The present invention is concerned with both a circular grid and a semicircular or polygonal grid.

In order that the invention be more clearly understood, a description will now be given in the following of preferred embodiments of the invention, taken in connection with the accompanying drawings, in which.

Figure 1:
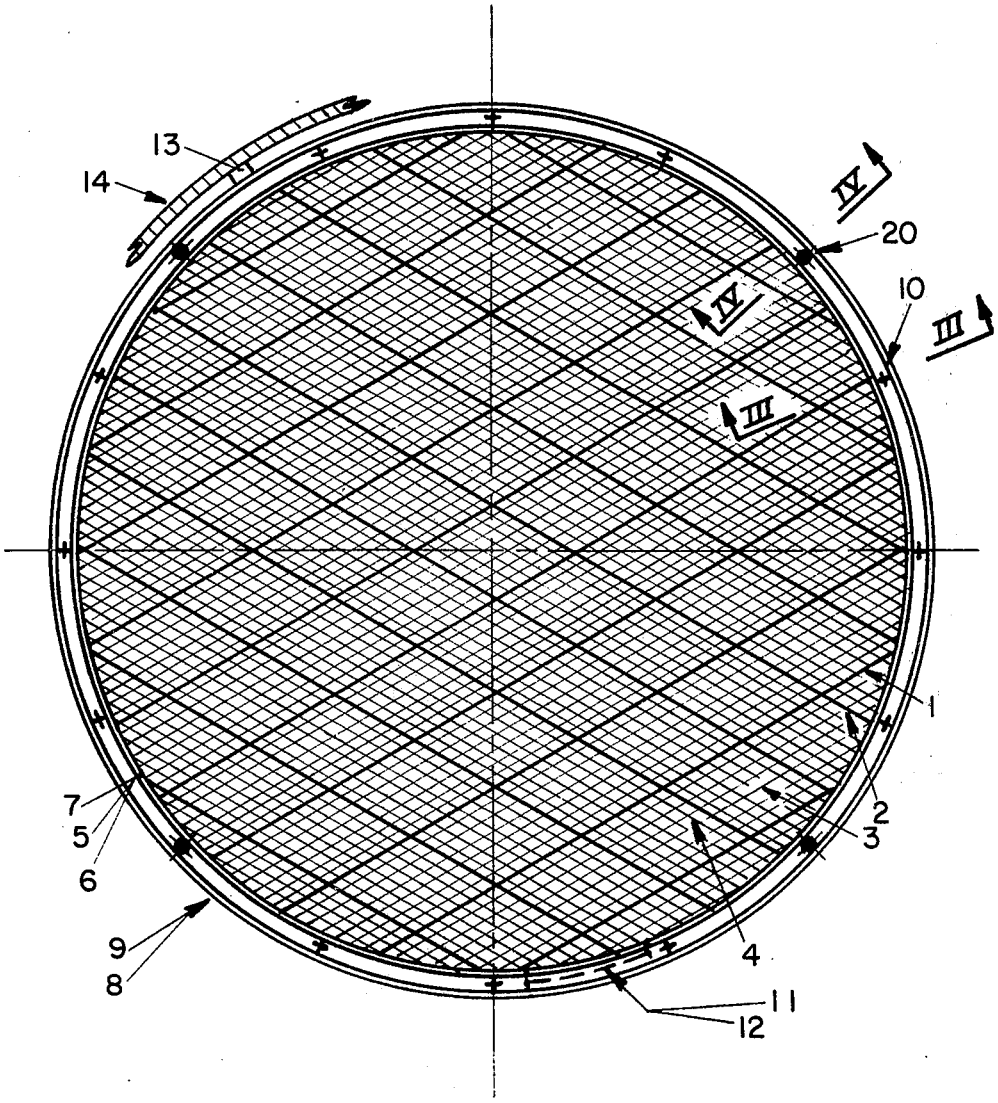
FIG. 1 is a plan view showing a grid of circular shape according to the invention, also showing a portion of the generator housing or wrapper along with the associated centering system for the grid in said wrapper.
Figure 2:
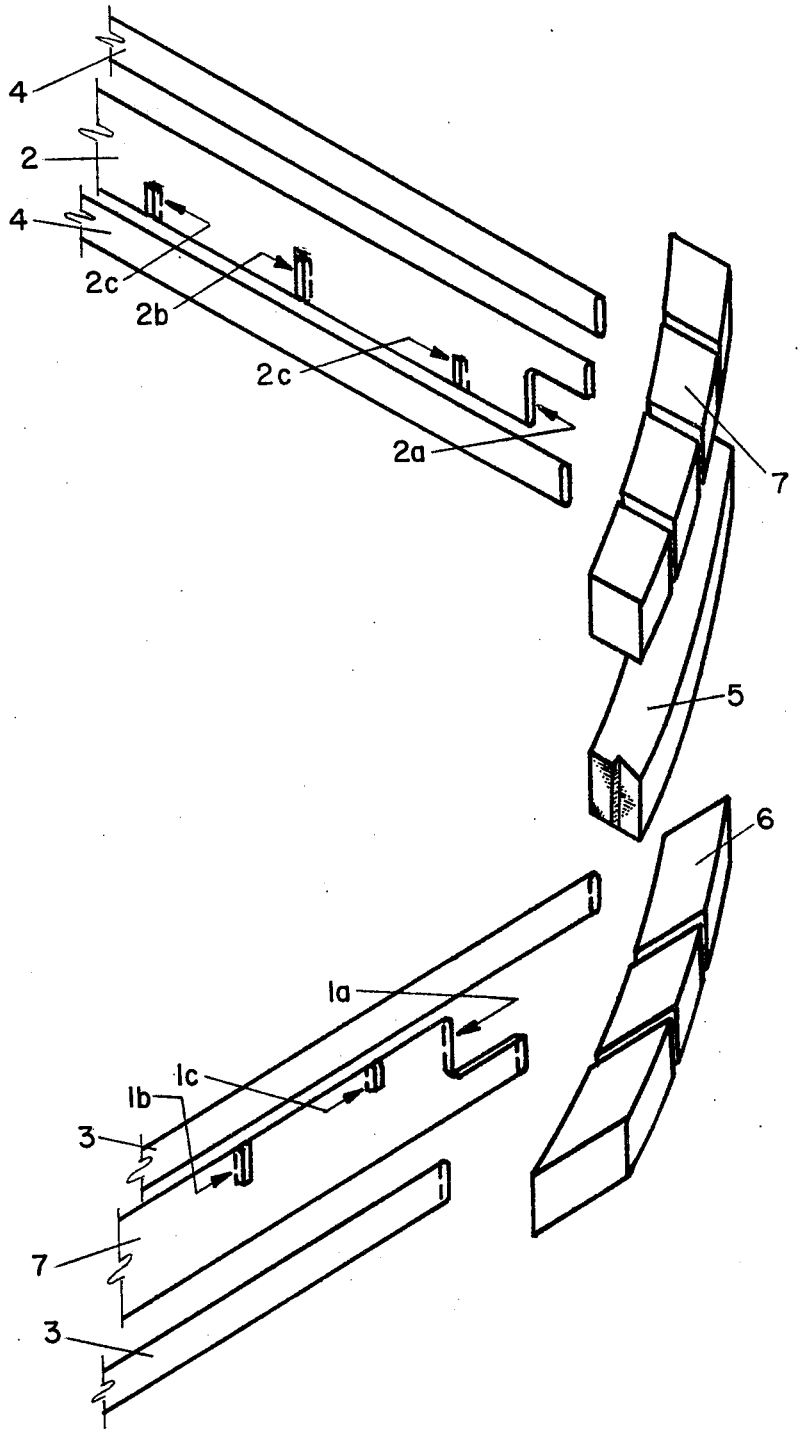
FIG. 2 is an exploded view showing a peripheral portion of the grid, comprising a number of strips and some of the pieces or elements making up the grid frame; the whole as prior to starting the grid assembling.
Figure 3:
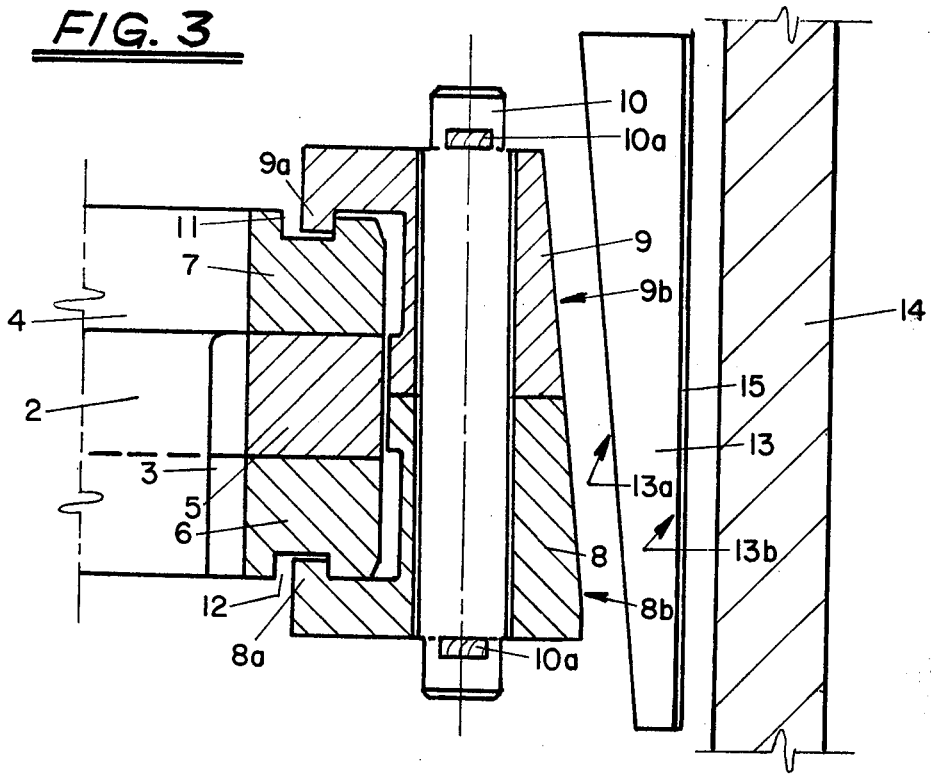
FIG. 3 is a sectional view taken along line III—III of FIG. 1 and shows a portion of the grid frame, wherein some strips are depicted, as well as the system for assembling the grid within the generator casing; in this figure, some pieces or elements are shown in exploded view.

Referring first to FIGS. 1–3, it will be seen that a grid according to the invention comprises a double series of main carrier or main strips 1 and 2, which are so worked that at the crossing thereof each of the plates are milled by half the height, thereof, that is have notchings 1*b* and 2*b*, respectively. Provision is also made for secondary strips 3 and 4, which are not worked or machined and penetrate into the shallower grooves 1*c* and 2*c*, respectively, which grooves have been provided in said main strips 1 and 2. According to this embodiment, all of these strips are made of stainless steel and are to be assembled on a frame, made of carbon steel, for example.

The method of manufacture is as follows:

Main strips 1 and 2 of stainless steel are machined in a pack of about 20–30 strips, by serially milling both the deepest grooves (1*b* and 2*b*, respectively) and the shallowest grooves (*c* and 2*c*, respectively) provided on each series of plates, preferably using multiple milling machines. Moreover, the end of these strips is L-shaped, wherein the material is removed from the groove side, that is the two ends of the strips are provided as shown at 1*a* and 2*a*. The frame is connected to the central strips by penetration of a tooth member 8*a* and 9*a*, respectively, into two slots 11 and 12, as discussed hereinafter. Said end slots provided on the strips cannot be made in the same manner: thus, such slots should be machined piece by piece, as both the width and direction thereof will depend on the final position of each strip in the circular grid. These external slots will thus be made only successively at grid assembling, as it will be explained in the following. Assembling of the individual strips to form the grid lattice is carried out on a horizontal plane with the aid of a mounting jig. At each crossing of the main strips 1 and 2 this jig preferably has pegs or stakes ensuring the location for the intersecting points of all of the main strips.

By way of example, a standard grid of this type could comprise two dozen carrier or main strips and eight secondary strips for each of the carrier strips, with the diameter of the finished grid amounting to about 3 m. For example, the height of a primary strip may be of 60 mm and that of the secondary strips may be of about 20 mm; for example, each strip may be 3 mm thick. Such a type of grid is capable of accomodating about 4,000 U-tubes for a total weight of about 60 ton.

At first, the lower main strips 1 terminating at the bottom with a L, the lowest portion of which is of the same height as the secondary strips, are arranged on the mounting jig. As above mentioned, no end slot is provided. Then piece or element 5 is assembled, which is a ring of carbon steel in a continuous form or comprising a plurality of pieces then made fast with one another. This ring 5 is of such a height that it can be inserted between strips 3 and 4 and merely serves as a spacer or gauge, and in case could be even omitted by otherwise making and dimensioning the other pieces or elements making up the grid frame. Now, the upper main strips are assembled, these strips also having downward facing L-shaped ends, that is overturned so as to prevent an empty portion 2*a* lying on that side on which the millings have been provided. The secondary strips 3 and 4 are now inserted, these strips penetrating into the shallower millings or grooves 1*c* and 2*c*. The ends thereof will insert under and over ring 5. Between each end of adjacent strips a (lower) spacer 6 and an (upper) spacer 7 of carbon steel or in case also of other material are now inserted. The mutual contact surfaces between the strip ends and spacers 6 and 7, as well as the surfaces of ring 5, will have been already prepared (such as by sandblasting or pickling) to receive a layer of metal glue (for example, base and reactor polymerizing at cold condition or by slight heating), the glue being of hot water soluble type or in case soluble with other solvents. This glue will completely clamp elements 1, 2, 3, 4, 5, 6 and 7 to one another, forming an integral unit. Thus, the upper and lower slots 11 and 12 in blocks 6 and 7 and at all of the strips ends can be turned. Assembling is then carried out for the outer rings 8 and 9, also made of carbon steel, which can be interconnected by means of bolts or pins 10 welded at 10*a*. Said outer rings are provided with a tooth member 8*a* and 9*a*, respectively, the radial size of which is less than that of the slot, turned as above mentioned.

Figure 4:
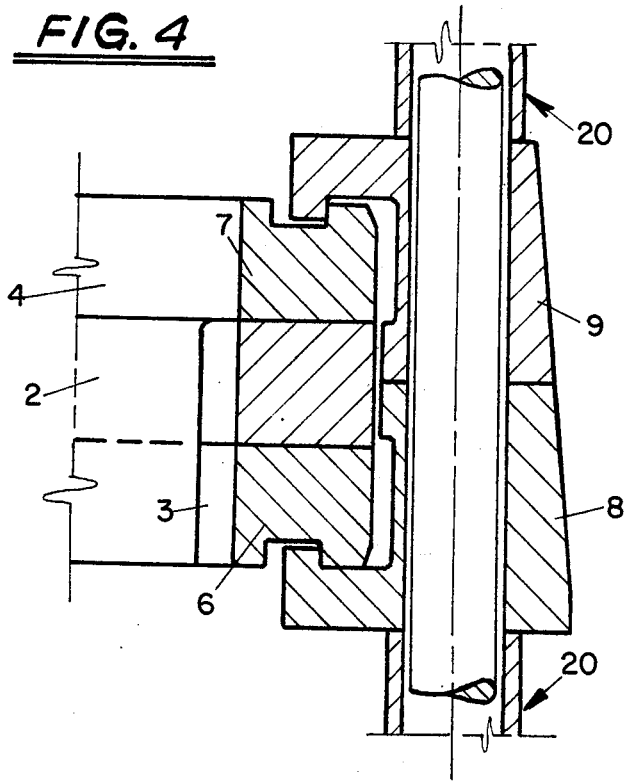
FIG. 4 is a sectional view taken along line IV—IV of FIG. 1, showing a frame portion along with a spacing element of the grid.

The dimension of rings 8 and 9 and particularly of tooth members 8*a* and 9*a* is such that at room temperature the external surface of slots 11 and 12 will contact the inner surface of the tooth members, as it is shown in FIGS. 3 and 4. This is necessary because all pieces 1, 2, 3, 4, 5, 6, 7 made fast together have to be fast also at room temperature with the outer rings 8 and 9.

The gluing providing for grid rigidity, is effective for the above slot turning and together with the respective position of each tooth and slot at room temperature provides the grid with a suitable rigidity during the steps of tube assembling and generally as the steam generator is moved and rotated at the manufacturing stage thereof, in addition to transport which is generally effected by land or by sea at great distances, as well as assembling in situ prior to its setting at work. Thus, these steps are carried out with the tubes horizontally arranged, that is the grids, after assembling and stiffening as above discussed, are arranged within circular wrapper 14 in a number ranging from six to nine, so that each of the grids lie on a vertical plane and are retained at a certain mutual distance by means of spacers 20 (FIG. 4) made of stainless seel; then, after alignment of the grid lattice, which is effected as explained in the following, inserting of tube bundle is initiated, this latter weighing about 60 ton, which weight shall be supported by such stiffened grids. It should be noted that not only these grids must bear the tube bundle without breakage, but must also be so rigid as not to become misaligned during loading, that is the tubes will be as readily inserted at loading beginning as at the end of the process, when the grids are bearing the maximum load.

Correct alignment of grids with the end tube sheet is carried out as follows (see FIG. 1 and 3): the frame for each grid, and particularly elements 8 and 9 in the present example, have the outer wall thereof inclined to form a conical surface; for example, a number of six to nine grids are vertically arranged, as above mentioned, within said wrapper 14 of the generator, which is also made of carbon steel. Inserted between the inner wall of the generator and grids are wedge members 13 capable of moving every individual grid in its vertical plane, so that each grid is correctly aligned with the holes of the tube sheet, in which all of the tubes are secured (welded and expanded). These wedge members 13 are connected by the inclined wall 13*a* thereof with the conical surfaces 8*b* and 9*b* of frames 8 and 9, respectively, to which they are welded, while the flat wall 13*b* thereof, facing the tube plate wrapper, is preliminarly covered with a layer of glue 15, of the same type as that above mentioned, which is solidified to form a thickness fast with the wedge member, the latter bearing against said casing 14 without being clamped thereagainst.

As the tube bundle is assembled, the tubes are inserted under controlled operation, an operator being capable of passing between one and another grid by means of a top movable portion provided in the grid.

When the generator is operated, the passage of water and saturated steam at such a temperature as 150°–200° C will melt said glue and the strips can freely expand, that is strips 1, 2, 3 and 4 of stainless steel will slide between spacers 6 and 7 in virtue of the provision of the required gaps or clearances. Thus, the frame components, that is elements 8, 9, 5, 6 and 7 all made of carbon steel will expand to a less extent.

Also the glue layer 15 on the outer surface 13*b* of wedge members 13 inserted about the grid will get unstuck and clear a gap or clearance having the same as that of the previously inserted glue. This will permit an axial sliding movement between the pack of grids, which are kept spaced apart from one another by said spacing units 20 of stainless steel, and the carbon steel wrapper.

It should be noted that the frame tooth member 8*a* is also for holding the spacers in place, when becoming loose in operation.

Figure 5:
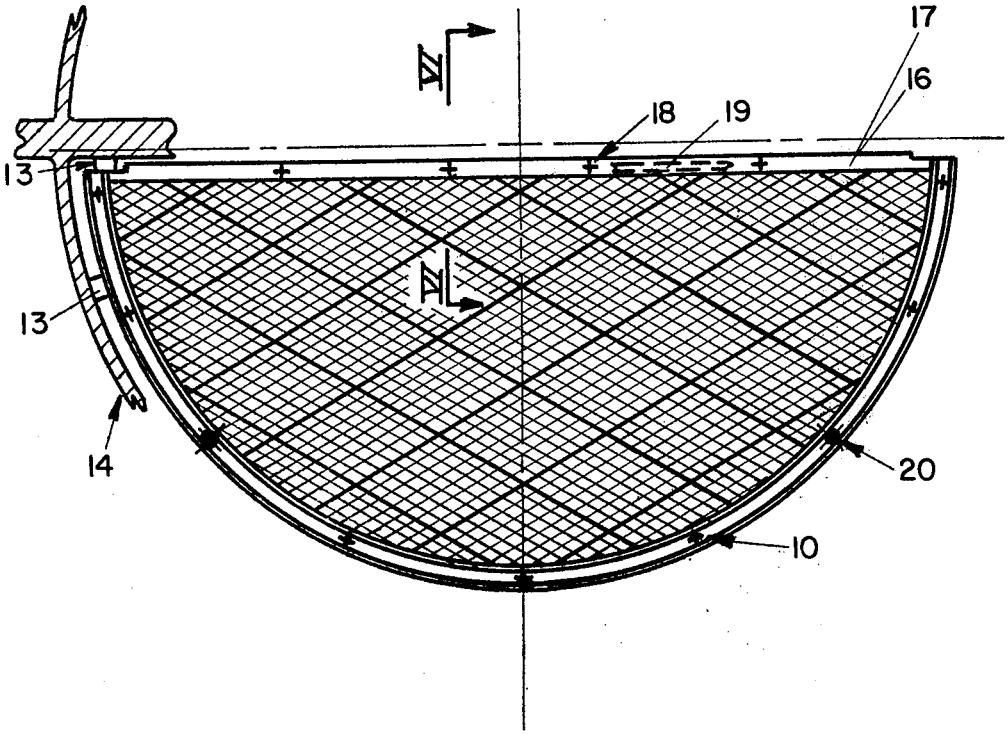
FIG. 5 is a view showing a semicircular grid according to the invention and the centering system for such a grid.
Figure 6:
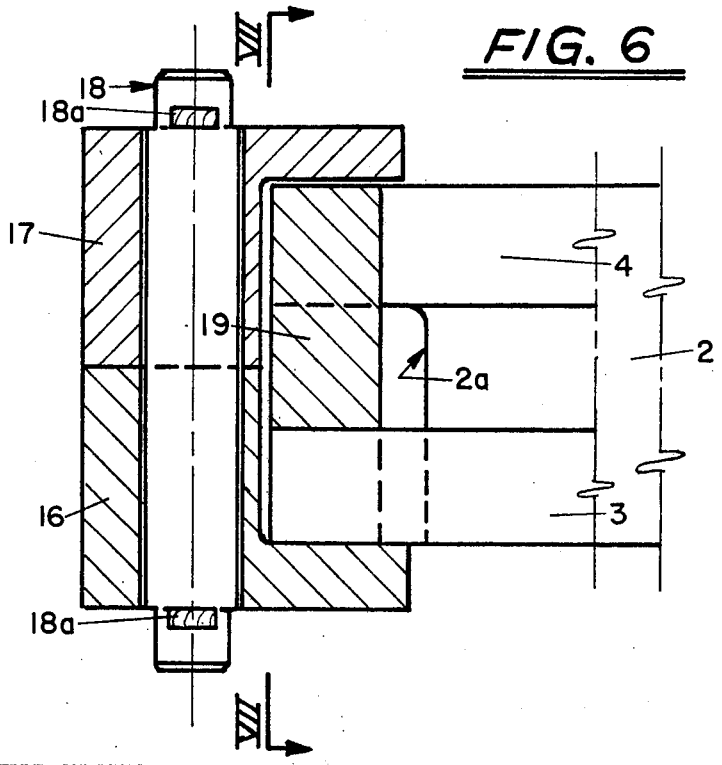
FIG. 6 is a detail of the semicircular grid, and more particularly a sectional view taken along line VI—VI of FIG. 5.
Figure 7:
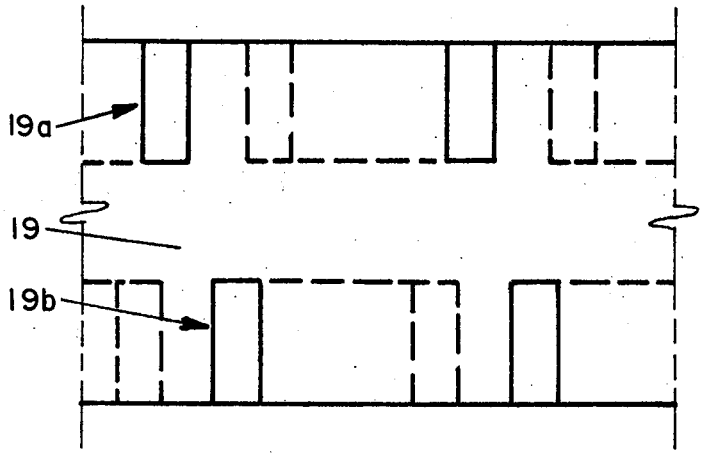
FIG. 7 is a sectional view taken along line VII—VII of FIG. 6, that is showing a detail of the frame.

A semicircular grid, as shown in FIGS. 5–7, is formed so that its circular portion is exactly the same as the respective portions of the circular grid according to the foregoing description, whereas its straight frame portion, which is also made of carbon steel, otherwise provides for thermal expansion. The straight frame portion, shown in sectional view in FIG. 6, comprises two L-beams 16 and 17, which are arranged and interconnected by a bolt or pin 18 welded at 18*a* to said beams, so as to form a C-member containing the spacing tie 19 and the ends of all of said strips 1, 2, 3 and 4.

It should be noted that the main strips 1 and 2 are shaped at the ends thereof to present a L-shape 1*a* and 2*a*, respectively, just as provided for the same ends reaching within the circular frame. The spacing tie 19 will have top and bottom sloping millings or grooves 19*a* and 19*b*, respectively. The milling or groove width size will be such that the ends of plates 2 and 4 and the ends of strips 1 and 3 can penetrate into the millings or grooves 19*a* and 19*b*, respectively. The opposite sloping of millings or grooves 19*a* and 19*b* will depend on the orientation of the associated strip units.

It should be noted that the ends of all of said strips 1, 2, 3 and 4 are arranged with respect to the straight frame so as to provide a certain axial clearance, or in other terms, so that the strips can freely expand without interferring with the frame. Said spacing tie 19 will accomplish the function of causing the plates to retain the mutual position thereof, that is to maintain always unaltered the lattice geometry.

Other approaches are also possible, while maintaining unaltered the basic concept of the invention.

What is claimed is:

1. A method of manufacturing a grill-type support suitable to act as a support and tube spacing member for steam generators (particularly natural circulation steam generators for pressure water reactors), heat exchangers and the like, said support including an outer frame enclosing a lattice grid, said grid comprising strips having a determined thermal expansion, said frame being made of another material having different thermal expansion, characterized in that during assembling the outer frame is connected to the strips so as to be fast therewith and remain so for all the time required for manufacture, transport and erection, whereas as soon as said generator is set to work said frame of different material from the strips can move relative to said strips, so that, while surrounding and supporting such strips, a different thermal expansion is allowed for said strips and frame.

2. A method as claimed in claim 1, characterized in that the frame is rigidly connected by means of a metal glue to the strips on assembling, the glue being such that it can be melted either by steam or other type of solvent, or merely on reaching a determined temperature as said grid is set to work.

3. A method as claimed in claim 1 in which a plurality of supports are positioned in longitudinally spaced relation within a housing having a tube sheet therein characterized in that each of the grids are centered with respect to the tube sheet by providing said frame with an inclined peripheral surface and inserting wedge members between said frame and generator housing, the wedge members moving the position of the grid within its plane.

4. A method as claimed in claim 3, characterized by the provision between the outer surface of each wedge member and housing for a layer of material that can become loose or melt as the apparatus is set to work, clearing a determined play or clearance enabling the grid to slide in a direction perpendicular to its own plane.

5. A method as claimed in claim 4, characterized in that spacers are provided between the grids for longitudinal positioning relative to said generator housing.

6. The method of making a supporting grid for tubes of the type in which a plurality of such grids are assembled interiorly of a tubular housing to form a steam generator, heat exchanger and the like, said method comprising the steps of; assembling a plurality of strips, in crossing relationship to each other, and connecting a peripheral frame thereto in which the strips are constructed of material having determined thermal expansion characteristics and the frame is constructed of a material having different thermal expansion characteristics; constructing the connection portions of the strips and frame to enable relative movement therebetween when subjected to heat during use, and rigidly securing the strips and frame together to prevent relative movement therebetween during assembly, transport, installation in a housing and insertion of tubes to be supported, said step of constructing the connecting portions for rigidly securing the strips and frame together including the application of adhering material effective to rigidly interconnect the strips and frame when subjected to ambient conditions encountered from assembly to installation, the adhering material being rendered ineffective when subject to conditions encountered when the steam generator, heat exchanger and the like is operated.

7. The method as defined in claim 6 wherein the step of constructing the connection portions of the strips and frame includes the steps of interconnecting the ends of the strip with a ring having axially opposed surfaces, forming an annular groove in each of said strips and ring surfaces, constructing said frame of a pair of annular members having axially opposed, longitudinally inwardly extending annular projections having a width less than the width of the grooves, and clamping the annular members together with the projections received in the grooves with the difference in width enabling relative movement between the strips and frame when the adhering material is ineffective.

8. The method as defined in claim 7 together with the steps of assembling a plurality of assembled supporting grids in spaced relation interiorly of a tubular housing, said step of constructing said frame including the step of forming an inclined surface on the exterior of the annular members forming the frame thereby defining a frusto-conical surface on the periphery of the frame, and inserting a plurality of wedge members between the frame and housing to position the grids within the housing.

9. The method as defined in claim 8 together with the step of permanently and rigidly affixing said wedge members to said frame, and applying a layer of adhering material between the wedge members and the housing to rigidly secure the wedge members and frame to the housing when subjected to ambient conditions from assembly to installation, the adhering material being rendered ineffective when subjected to conditions encountered when the steam generator, heat exchanger and the like is operated.

* * * * *